US009728351B2

(12) United States Patent
Schroll et al.

(10) Patent No.: US 9,728,351 B2
(45) Date of Patent: Aug. 8, 2017

(54) ELECTRICAL SWITCH OPERATED BY LOCKABLE PUSH BUTTON ACTUATOR, AND RETROFIT METHOD AND KIT

(71) Applicant: The Eastern Company, Wheeling, IL (US)

(72) Inventors: Matthew D Schroll, Glendale Heights, IL (US); Michael O Misner, Lake Villa, IL (US); Thomas Heinrich, Roselle, IL (US)

(73) Assignee: The Eastern Company

( * ) Notice: Subject to any disclaimer, the term of this patent is extended or adjusted under 35 U.S.C. 154(b) by 130 days.

(21) Appl. No.: 14/121,376

(22) Filed: Aug. 26, 2014

(65) Prior Publication Data

US 2015/0144466 A1 May 28, 2015

Related U.S. Application Data

(60) Provisional application No. 61/963,210, filed on Nov. 27, 2013.

(51) Int. Cl.

| | |
|---|---|
| ***H01H 9/28*** | (2006.01) |
| ***H01H 13/14*** | (2006.01) |
| *H01H 27/06* | (2006.01) |

(52) U.S. Cl.

CPC ..... *H01H 13/14* (2013.01); *H01H 9/285* (2013.01); *H01H 27/06* (2013.01); *Y10T 29/49105* (2015.01)

(58) Field of Classification Search

CPC ..... H01H 9/28; H01H 9/285; H01H 1/00; H01H 1/12; H01H 3/00; H01H 3/12; H01H 9/00; H01H 9/02; H01H 9/16; H01H 13/00; H01H 13/02; H01H 13/04; H01H 13/10; H01H 13/12; H01H 13/50; H01H 13/52; H01H 2003/12; H01H 2223/00; H01H 2223/01; H01H 2223/012; H01H 2223/014; H01H 2223/028; H01H 2223/044; H01H 2223/058; H01H 2231/026; H01H 3/14; H01H 27/06; Y10T 29/49105; Y10T 70/7107; Y10T 70/7124; Y10T 70/5969; E05B 47/06; E05B 81/08; E05B 81/56; E05B 13/105; E05B 83/16

USPC .. 200/43.13, 318.2, 566, 19.07, 19.1, 19.13, 200/19.18, 61.59, 61.64, 61.66, 61.67, 200/520, 17 R, 43.18, 345, 5 A, 537, 538, 200/522, 237, 329, 341; 292/129, 198; 70/360, 367, 271, 278.2, 278.3, 279.1, 70/447–451

See application file for complete search history.

(56) References Cited

U.S. PATENT DOCUMENTS 3,200,623 A * 8/1965 Peters ..... E05B 47/06 70/255
3,809,838 A * 5/1974 Coppola ..... H01H 13/12 200/292

(Continued)

*Primary Examiner* — Anthony R. Jimenez
(74) *Attorney, Agent, or Firm* — David A. Burge

(57) ABSTRACT

A simple kit of parts is provided that can be used to replace a few easily removed elements of a lockable push button actuator of a mechanical locking mechanism to convert the push button actuator to a lockable actuator for controlling a switch that can serve as a component of an electrical locking system. Other aspects of the invention relate to a method of making the mechanical to electrical conversion, and to a lockable actuator for operating an electrical switch connected to the actuator.

18 Claims, 7 Drawing Sheets

(56) References Cited

U.S. PATENT DOCUMENTS

| | | | | |
|---|---|---|---|---|
| 4,009,357 | A | 2/1977 | Naylor | 200/42 |
| 4,580,019 | A | 4/1986 | Takahashi | 200/43.08 |
| 4,634,822 | A | 1/1987 | Goeke | 200/43.08 |
| 4,956,983 | A | 9/1990 | Okamura et al. | 70/241 |
| 5,308,126 | A | 5/1994 | Weger, Jr. et al. | 292/53 |
| 5,401,925 | A * | 3/1995 | Sambar | H01H 3/12 200/296 |
| 6,113,160 | A | 9/2000 | Johansson et al. | 292/169 |
| 6,501,037 | B2 | 12/2002 | Gressier et al. | 200/341 |
| 6,575,503 | B1 | 6/2003 | Johansson et al. | 282/170 |
| 6,686,551 | B2 | 2/2004 | Pasotto | 200/566 |
| 6,755,449 | B2 | 6/2004 | Weinerman et al. | 292/198 |
| 6,782,725 | B2 | 8/2004 | Linares | 70/360 |
| 6,861,602 | B2 | 3/2005 | Juga | 200/341 |
| 7,126,066 | B1 | 10/2006 | Corcino et al. | 200/43.13 |
| 7,205,492 | B1 | 4/2007 | Corcino et al. | 200/43.13 |
| 8,084,701 | B1 | 12/2011 | Misner | 200/43.13 |

* cited by examiner

ELECTRICAL SWITCH OPERATED BY LOCKABLE PUSH BUTTON ACTUATOR, AND RETROFIT METHOD AND KIT

REFERENCE TO PROVISIONAL APPLICATION

This utility application claims the benefit of the Nov. 27, 2013 filing date of Provisional Application Ser. No. 61/963,210 which carried the same title as the present application and named the same inventors, the disclosure of which Provisional Application is incorporated herein by reference.

FIELD OF THE INVENTION

The present invention has method, kit and new product aspects.

In one respect, the present invention relates to a method for quickly and easily converting a lockable push button actuator mechanism of a type presently being used to operate mechanical locking systems on large tool containers and the like, to a lockable push button actuator mechanism that operates an electrical switch that can serve as a component of an electrically operated locking system—such as an electrically operated locking system that is being provided to replace an existing mechanical locking system on a large tool container or the like.

In another respect, the present invention relates to a kit of parts that can be used to replace a few easily removed elements of a lockable push button actuator mechanism such as is in use with a mechanical locking system. When a lockable push button actuator mechanism is retrofitted, repurposed and upgraded by installing the kit of parts to replace a few elements that have been removed from the actuator mechanism, the lockable push button actuator mechanism is rendered capable of operating an electrical switch that is connected to the actuator mechanism, so the combined actuator mechanism and electrical switch can function as a component of an electrically operated locking system.

In yet another respect, the present invention relates to a lockable push button actuator mechanism that incorporates an electrical switch, thereby providing, in essence, a new product that can be supplied for use as a component of an electrically operated locking system.

BACKGROUND

Lockable push button actuator mechanisms suitable for use with mechanical locking systems such as are used on large tool containers and the like are well known. Patents that disclose such lockable push button actuator mechanisms that are well suited for use with mechanical locking systems include U.S. Pat. No. 7,126,066 issued Oct. 24, 2006, U.S. Pat. No. 7,205,492 issued Apr. 17, 2007, and U.S. Pat. No. 8,084,701 issued Dec. 27, 2011. These patents are referred to later herein as the Lockable Push Button Actuator Patents, and their disclosures are incorporated herein by reference.

Lockable push button actuator mechanisms such as are disclosed in above-identified patents each have a generally tubular housing that can be mounted in an opening formed through a metal panel of a large tool container or the like. The housing typically has a relatively large diameter front bezel that defines a front face of the housing, and smaller diameter portions that extend rearwardly from the front bezel.

A push button subassembly is mounted for forward and rearward movement within a passage that extends centrally through the housing. The subassembly has a push button that is biased to project forwardly from the front face of the housing. A keyway opens forwardly through the front of the push button, and is designed to receive a key that can be turned between locked and unlocked orientations when a suitably configured key is inserted into the keyway. The locked and unlocked orientations to which the keyway can be turned are prominently marked by symbols provided on the front face of the housing. The push button can be manually depressed to a protected position where the push button can be latchingly retained substantially flush with the front face of the housing when the keyway is turned to the locked orientation.

Among other components of the lockable push button actuator mechanism are a tubular rear component that projects rearwardly from the housing, and a plunger that is carried inside the tubular rear component. If the keyway is turned to the unlocked orientation, both the tubular rear component and the plunger are drivingly connected to the push button, and therefore move forwardly and rearwardly in unison with the push button. If the keyway is turned to the locked orientation, only the plunger is drivingly connected to the push button, hence only the plunger moves rearwardly when the push button is depressed. When the rearwardly moving push button reaches a protected depressed position with the keyway turned to the locked orientation, it is latchingly retained substantially flush with the front face of the housing.

Connected to the rear end region of the tubular rear component is a tapered, nosecone shaped member which defines at its rearmost end an engagement surface that is commonly used to operate components of a mechanical locking system. When the keyway at the front of the push button is turned to the unlocked orientation, the tubular rear component and the nosecone shaped member connected thereto are both drivingly connected to the push button and therefore move forwardly and rearwardly in unison with the push button—hence the engagement surface moves forwardly and rearwardly with the push button. However, when the keyway is turned to the locked orientation, the tubular rear component and the engagement surface connected thereto do not move rearwardly when the push button is depressed, but the plunger situated inside the tubular rear component does move rearwardly with the depression of the push button, which is a feature of relative movement (of the tubular rear component and the plunger situated inside the tubular rear component) that has not been used until now to operate anything.

As will be explained, the present invention makes use of a relative movement that can take place between the tubular rear component and the plunger situated inside the tubular rear component to operate an electrical switch when the push button is depressed under certain conditions, namely when the keyway of the push button is turned to the vertical locked orientation. To retrofit existing lockable push button actuator assemblies or mechanisms to make use of this relative movement, the present invention calls for a nosecone shaped member that is carried by the tubular rear component to be removed and replaced by an adapter that carries an electrical switch having an operator that can be engaged by the plunger to operate the electrical switch when certain relative movement takes place between the tubular rear component and the plunger—thereby enabling a lockable push button actuator (which has been retrofitted by removing its nosecone shaped member and replacing it with an electrical switch) to be used as a component of an electrically operated locking system.

SUMMARY OF THE INVENTION

In some aspects of the present invention, a kit and method are provided for quickly and easily converting a push button actuator mechanism of a mechanical locking system to a lockable device for operating an electrical switch that can serve as a component of an electrically operated locking system.

In some aspects of the present invention, a kit and method are provided for retrofitting, repurposing and upgrading a push button actuator assembly of the type disclosed in the referenced Lockable Push Button Actuator Patents that may already be in service and used to operate a mechanical locking system, to enable the push button actuator mechanism to serve the entirely new function of operating an electrical switch that can serve as a component of an electrically controlled locking system.

In some aspects of the present invention, a simple set or kit of components is provided that can be substituted for a nosecone shaped member of a push button actuator assembly to enable the push button actuator assembly to function as electrical switch that is operated via depression of a lockable push button of the push button actuator assembly.

In some respects, the present invention provides a lockable push button actuator mechanism that includes an electrical switch which can be operated by depressing a lockable push button of the mechanism.

DESCRIPTION OF THE DRAWINGS

A fuller understanding of the present invention may be had by referring to the description and claims that follow, taken in conjunction with the accompanying drawings, wherein:

DETAILED DESCRIPTION

The present invention has a "method" aspect, a "kit" aspect, and a "new product" aspect, which will become apparent as the detailed description that follows unfolds. All three of these aspects of the present invention have as their foundation a lockable push button actuator mechanism that is disclosed in the Lockable Push Button Actuator Patents identified above.

Figure 6:
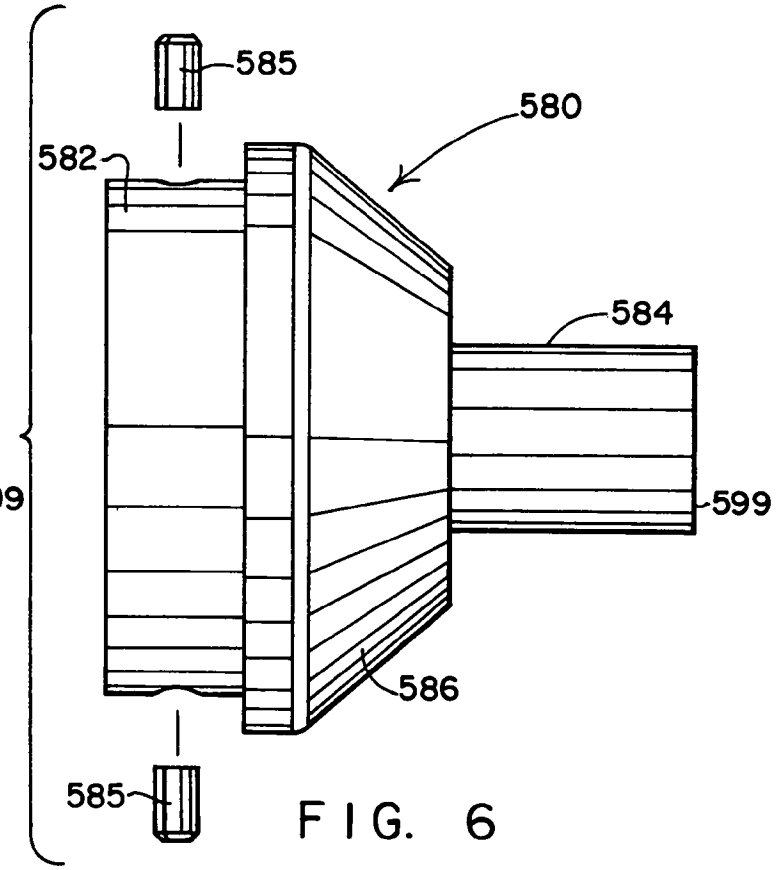
FIG. 6 is an exploded view showing the nosecone shaped member and the two friction-fit pins that can be removed to disconnect the nosecone shaped member from the rear end region of the tubular rear component.

In overview, a push button actuator assembly or mechanism of the type disclosed in detail in the Lockable Push Button Actuator Patents is indicated generally by the numeral 100 in FIGS. 1-4. A sectional view showing selected rear components of the actuator assembly or mechanism 100 is provided by FIG. 5. FIG. 6 shows three elements of the assembly or mechanism 100 that can be removed quite easily from the assembly or mechanism 100 in accordance with a "method" aspect of the present invention that enables the assembly or mechanism 100 to be converted from being capable of operating a mechanical locking system to serving as a push button operated electrical switch for use in an electrically operated locking system.

If the reader wants to fully grasp and completely understand the many components and the relatively complex operation of the push button actuator assembly or mechanism 100, the reader is referred to the lengthy and detailed description provided in the Lockable Push Button Actuator Patents. Only such features of the assembly or mechanism 100 as are pertinent to the present invention are described herein.

To aid the reader in taking easy advantage of the detailed disclosure of features of the push button actuator assembly or mechanism 100 that is provided in the Lockable Push Button Actuator Patents, all reference numerals that appear in FIGS. 1-6 hereof are identical to the reference numerals that are used in the Lockable Push Button Actuator Patents. Only FIGS. 7, 8 and 11 hereof contain additional reference numerals that are not found in the referenced Lockable Push Button Actuator Patents. In some of the drawings hereof, features that carry no reference numerals in drawings of the Lockable Push Button Actuator Patents are designated by the capital letters "P," "L," "U," "R," "S," "A" and "O."

Figure 7:
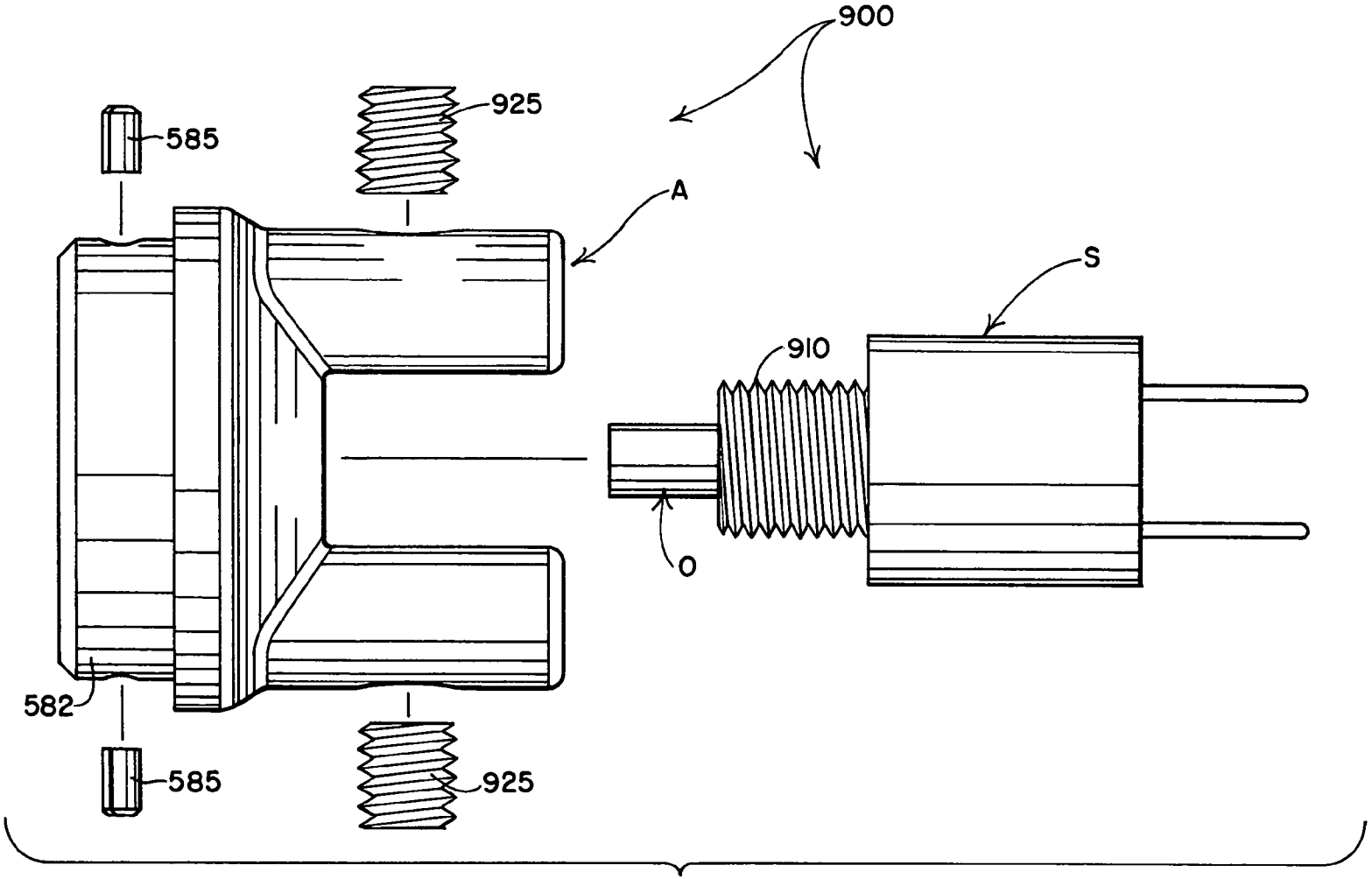
FIG. 7 is an exploded view showing an adapter and a pair of friction-fit pins that can be installed in place of the removed nosecone shaped member and its friction-fit mounting pins, and showing a commercially available electrical switch that can be threaded into the adapter, together with a pair of set screws that can be threaded into aligned holes on opposite sides of the adapter to securely retain the electrical switch in place.

A "kit" aspect of the present invention includes the six components or replacement parts which constitute a kit 900 that is shown only in FIG. 7. As will be explained, the components of the kit 900 can be easily installed on the assembly or mechanism 100 once the three elements depicted in FIG. 6 have been removed from the assembly or mechanism 100. The replacement parts of the kit 900 include an electrical switch S having a depressable operator O, an adapter A which is designed to mount the electrical switch S on the assembly or mechanism 100, a pair of friction-fit pins 585, and a pair of set screws 925. The switch S has a threaded front end region 910 that can be threaded into a threaded passage 920 (shown in FIGS. 8 and 11) to properly position the operator O of the switch S. The set screws 925 are installed to hold the switch S in a desired position for the operator O to be depressed only when the a plunger 540 (which is at the rear end of the push button P as will be explained) is moved a fraction of an inch from the position shown in FIG. 8 to the position shown in FIG. 11.

Figure 8:
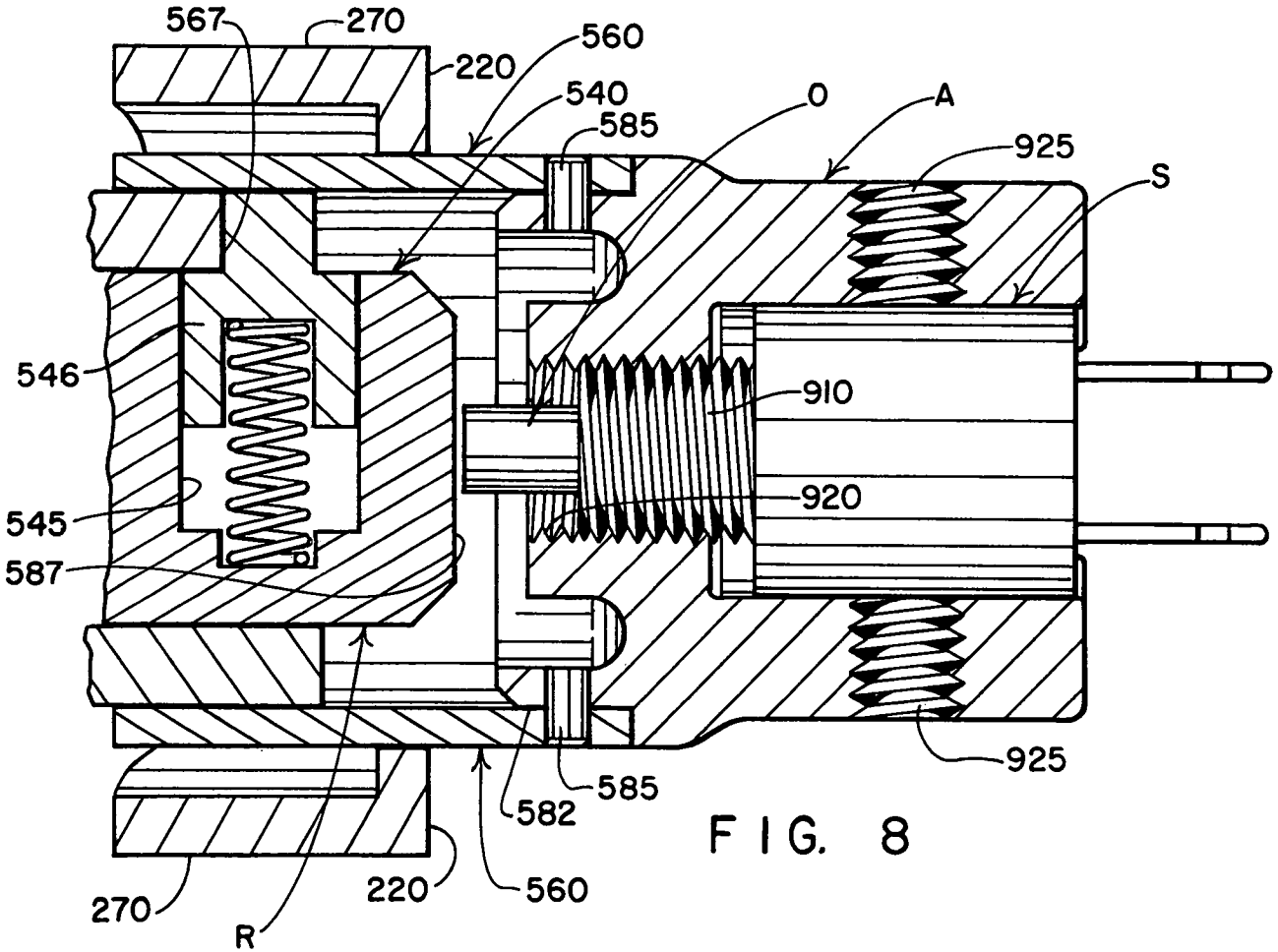
FIG. 8 is a sectional view showing the adapter and the electrical switch assembled and connected to the tubular rear component, with the friction-fit pins and the set screws securing these elements in place, and with the view showing more of the rear end region of the plunger of the actuator mechanism than appears in FIG. 5, with a spring-projected tumbler that is carried by the plunger extending behind a shoulder to latchingly retain the push button of the actuator mechanism in the depressed protected position shown in FIG. 4, with the plunger shown not depressing an operator component of the electrical switch.
Figure 11:
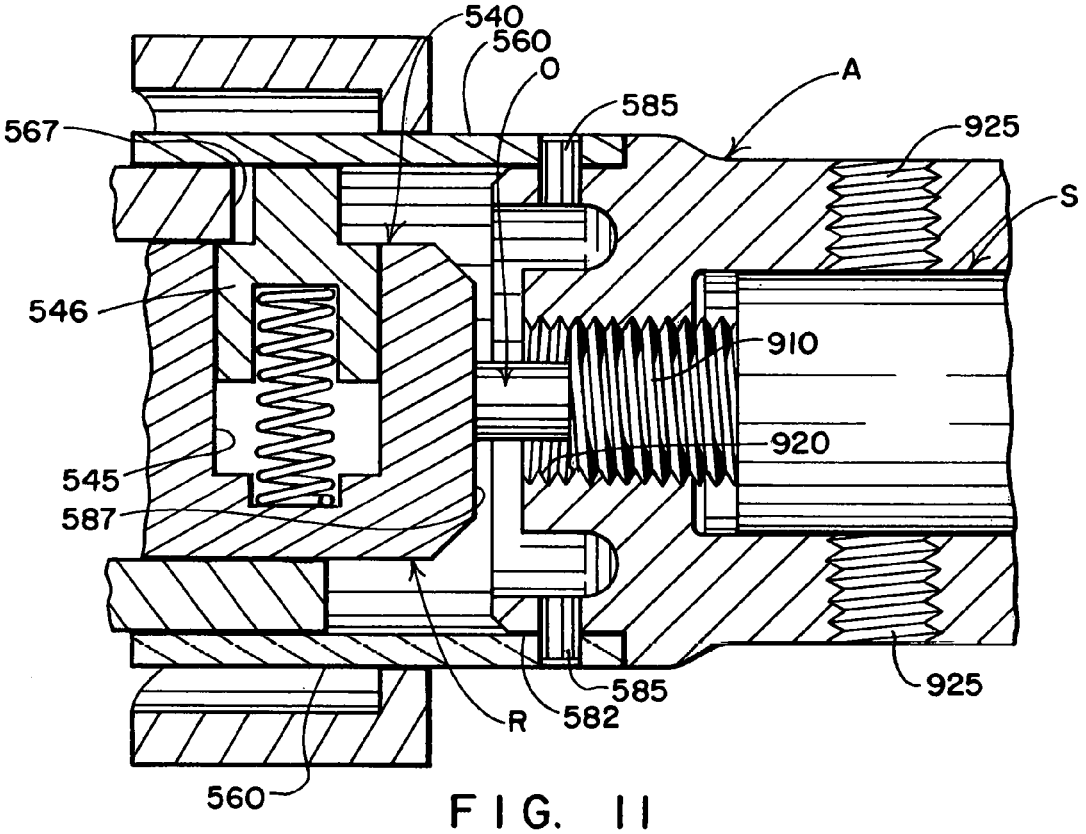
FIG. 11 is a sectional view similar to FIG. 8, with the view showing a plunger of the push button depressed a fraction of an inch into the housing and causing the operator component of the electrical switch to be depressed and the switch to be operated, which results from the push button being depressed a fraction of an inch into the housing in the manner shown in FIG. 10.

When the replacement parts of the kit 900 are installed in the manner shown in FIG. 8 to replace such removed elements as are shown in FIG. 6, the resulting retrofitted, upgraded and repurposed assembly or mechanism 100 can serve quite nicely to operate the electrical switch S in response to certain movements of a push button P that cause the plunger 540 to depress the operator O of the switch S as shown in FIG. 11.

Figure 4:
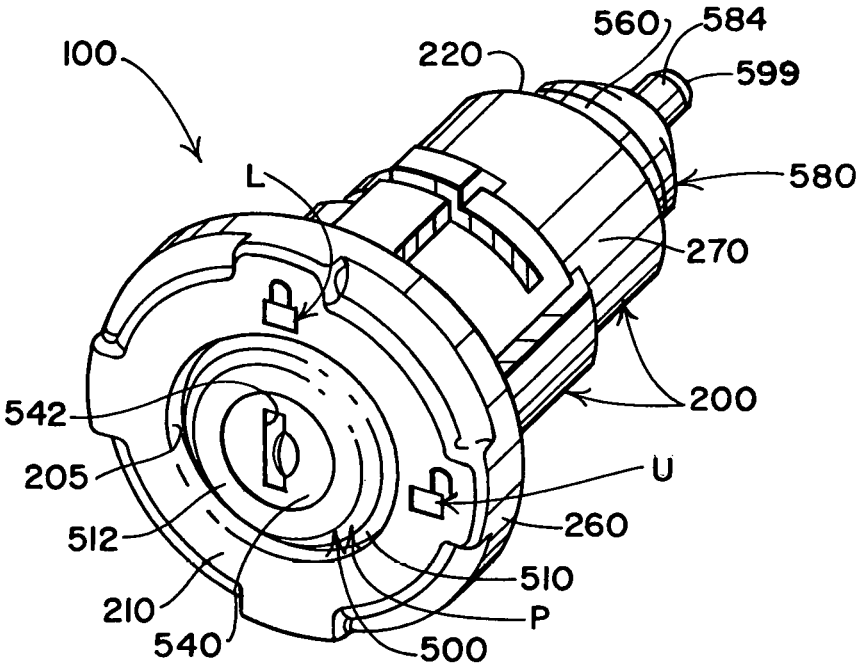
FIG. 4 is a perspective view of the push button actuator mechanism with the push button depressed as in FIG. 3, and with the keyway turned to the vertical locked orientation, it being noted that when the push button has been depressed while the keyway is turned to the vertical locked orientation, the tubular rear component of the mechanism has not been caused to extend rearwardly as shown in FIG. 3.
Figure 9:
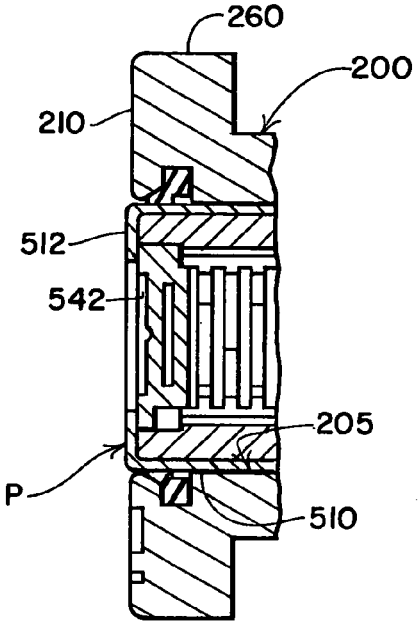
FIG. 9 is a sectional view showing a front end region of a housing of the push button actuator mechanism, with the view showing a push button of the mechanism in a protected depressed position at which the push button can be latchingly retained when the forwardly facing keyway is turned to the vertical locked orientation.
Figure 10:
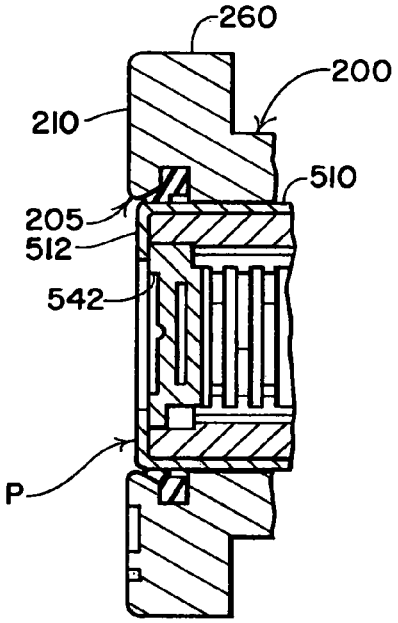
FIG. 10 is a sectional view similar to FIG. 9, with the view showing the push button depressed a fraction of an inch farther into the housing from the protected depressed position shown in FIG. 9.

The sectional view provided by FIG. 9 shows the push button P of the assembly or mechanism 100 in the depressed protected position where the push button P can be latchingly retained when a keyway 542 is turned to the vertical locked orientation shown in FIG. 4. A similar sectional view provided by FIG. 10 shows how the push button P can be depressed a fraction of an inch farther into the housing of the assembly or mechanism 100 (than is shown in FIG. 9) to operate the electrical switch S in a manner shown in FIG. 11.

A "new product" aspect of the present invention relates to the assembly or mechanism 100 equipped with the kit 900 of components shown in FIG. 7, and having a rear configuration as shown in the sectional view of FIG. 8, which can be operated as shown in FIG. 11. This "new product" can be provided directly from the factory for use as a component in electrically operated locking systems of various descriptions—instead of retrofitting an existing push button actuator assembly or mechanism presently being used with a mechanical locking system.

Features of the Lockable Push Button Actuator Assembly

The lockable push button actuator mechanism or assembly 100 that is more fully disclosed in the Lockable Push Button Actuator Patents is shown in FIGS. 1-4 that have been reproduced from drawings found in the Lockable Push Button Actuator Patents.

The mechanism or assembly 100 has a generally tubular housing 200 with a relatively large diameter annular front face 210, and a relatively small diameter annular rear surface 220. A passage 205 extends centrally through the tubular housing 200. The passage 205 opens in a forward direction through the front face 210, and opens rearwardly through the rear surface 220. A front bezel portion 260 of the housing 200 defines the front face 210. A generally tubular rearwardly extending portion 270 of the housing 200 defines the annular rear surface 220.

Figure 1:
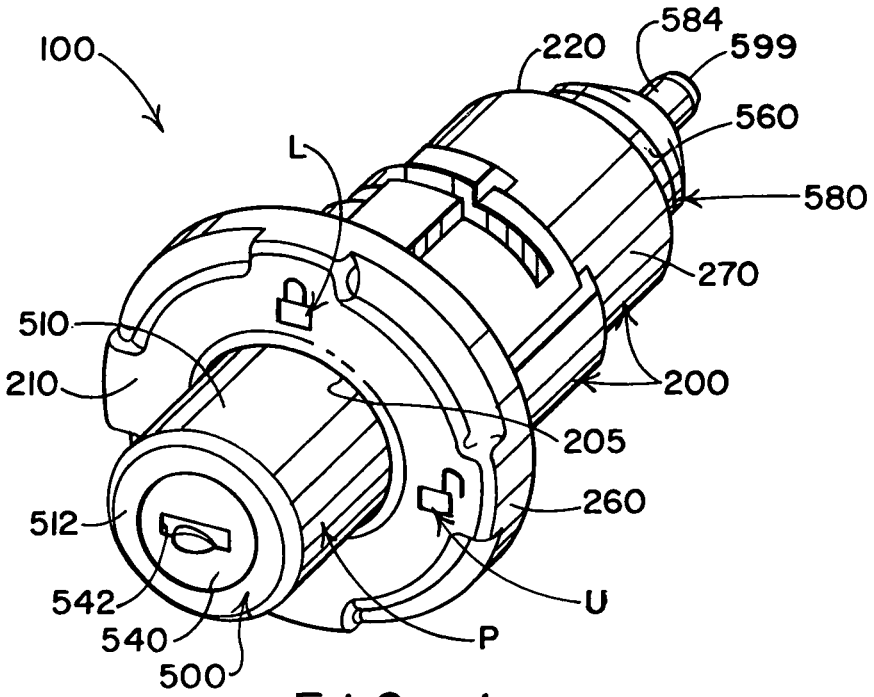
FIG. 1 is a perspective view of a push button actuator mechanism of the type disclosed in the referenced Lockable Push Button Actuator Patents, with the view showing a depressable push button extending forwardly from a generally tubular housing of the mechanism, and having a forwardly-opening keyway turned to a horizontal unlocked orientation aligned with an unlocked symbol at a 3 o'clock location on the front face of a relatively large diameter bezel portion of the housing.
Figure 2:
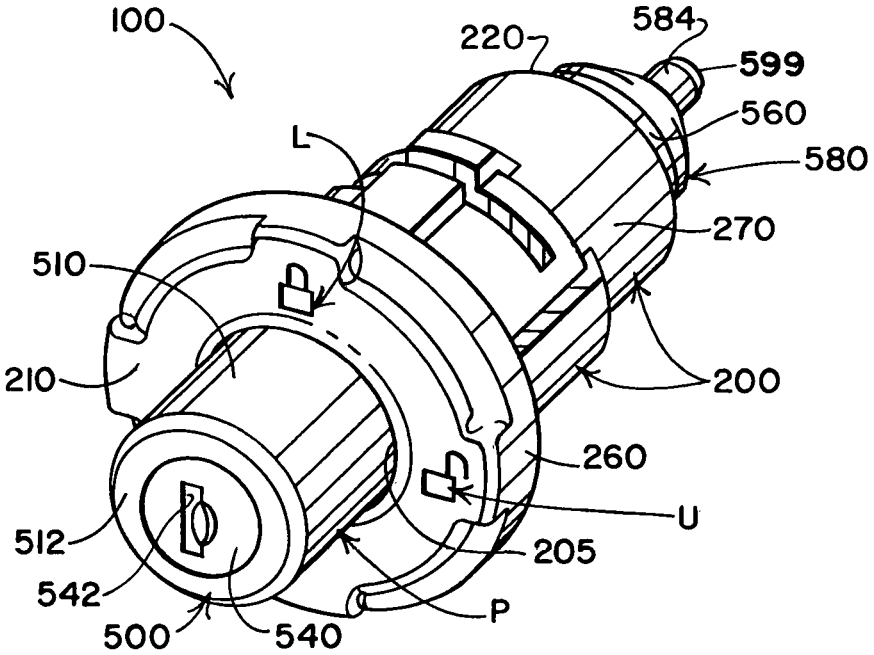
FIG. 2 is a perspective view similar to FIG. 1, but with the keyway turned to a vertical locked orientation aligned with a locked symbol at a 12 o'clock location on the front face of the bezel portion of the housing.

A push button subassembly 500 is movably carried in the passage 205. A push button P of the subassembly 500 is biased forwardly (by a spring component, not shown, carried within the generally tubular housing 200) toward a fully extended position of the push button P that is shown in FIGS. 1 and 2. The push button P can be manually depressed to a protected position (shown in FIGS. 3, 4 and 9) where the push button P resides substantially flush with the front face 210 of the housing 200.

When the push button P is in its fully extended position (as shown in FIGS. 1 and 2), the portion of the push button P that extends forwardly from the housing 200 is shrouded by a thin, snugly fitting front cover 510. The cover 510 is often formed from a material selected to provide the push button P with a distinctive color and a prominent appearance. A front surface 512 of the cover 510 has a centrally located opening through which a generally rectangular, forwardly opening keyway 542 can be seen.

Figure 3:
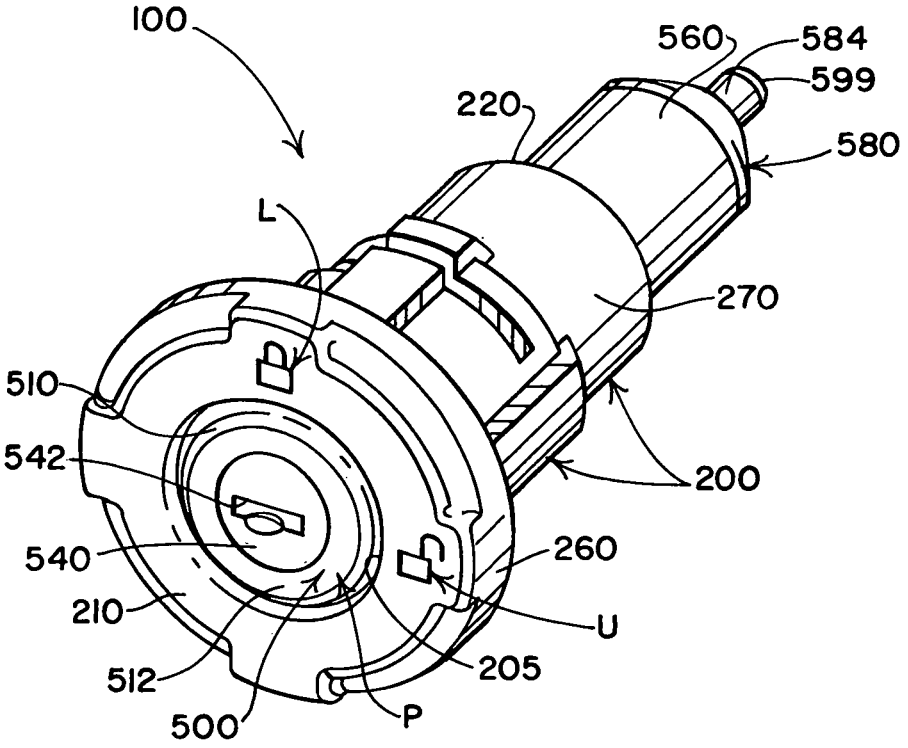
FIG. 3 is a perspective view of the push button actuator mechanism, with the view showing the push button depressed to a protected position substantially flush with the front face of the housing, and with the keyway turned to the horizontal unlocked orientation, it being noted that when the push button has been depressed with the keyway turned to the horizontal unlocked orientation, a tubular rear component of the push button actuator mechanism has been caused to correspondingly move rearwardly from the housing in comparison to such positions of the tubular rear component as are depicted in FIGS. 1 and 2.

The keyway 542 can be turned by an inserted key of appropriate configuration (not shown) to the horizontal unlocked orientation shown in FIGS. 1 and 3, pointing to an unlocked symbol U situated at a 3 o'clock position on the annular front face 210 of the housing 200. The keyway 542 can also be turned to a vertical locked orientation as shown in FIGS. 2 and 4, pointing to a locked symbol L situated at a 12 o'clock position on the annular front face 210 of the housing 200. Key removal is permitted when the keyway points to either of the locked or unlocked symbols L or U, respectively.

The keyway-carrying plug 540 (a front end region of which can be seen in FIGS. 1-4) is an elongate member that extends through the passage 205 of the generally tubular housing 200. A rear end region R of the plug 540 (which is also referred to herein as a plunger 540) defines an engagement surface 587 which can be seen in FIGS. 5 and 6. When the push button actuator assembly or mechanism 100 is used (in a traditional manner described in the referenced Lockable Push Button Actuator Patents) to operate and control a mechanical locking system (not shown herein), the lockable push button actuator mechanism or assembly 100 makes use of the rear end region R of the plug or plunger 540 to provide a transversely extending passage 545 that carries a spring-biased tumbler 546 (as shown in FIGS. 8 and 11).

When the depressable push button P is depressed to the position shown in FIG. 4 while the keyway 542 is turned to the vertical locked orientation, the push button P is latchingly retained in the depressed protected position of FIGS.

4 and 9 by the spring-projected tumbler 546 which extends behind a shoulder 567 (as shown in FIGS. 8 and 11). The latched retention of the plug or plunger 540 in the depressed protected position means that the push button P is also retained in the depressed protected position shown in FIGS. 4 and 9 where the front face of the push button P is shown to extend substantially flush with the front face 210 of the housing 200.

To release the push button P from being latchingly retained in the depressed protected position of FIGS. 4 and 9, a key of suitable configuration (not shown) is inserted into the keyway 542 and turned to the horizontal unlocked orientation of FIG. 3, whereupon the tumbler 546 no longer extends behind the shoulder 567, which permits the push button P to pop out to the fully extended position shown in FIGS. 1 and 2.

Figure 5:
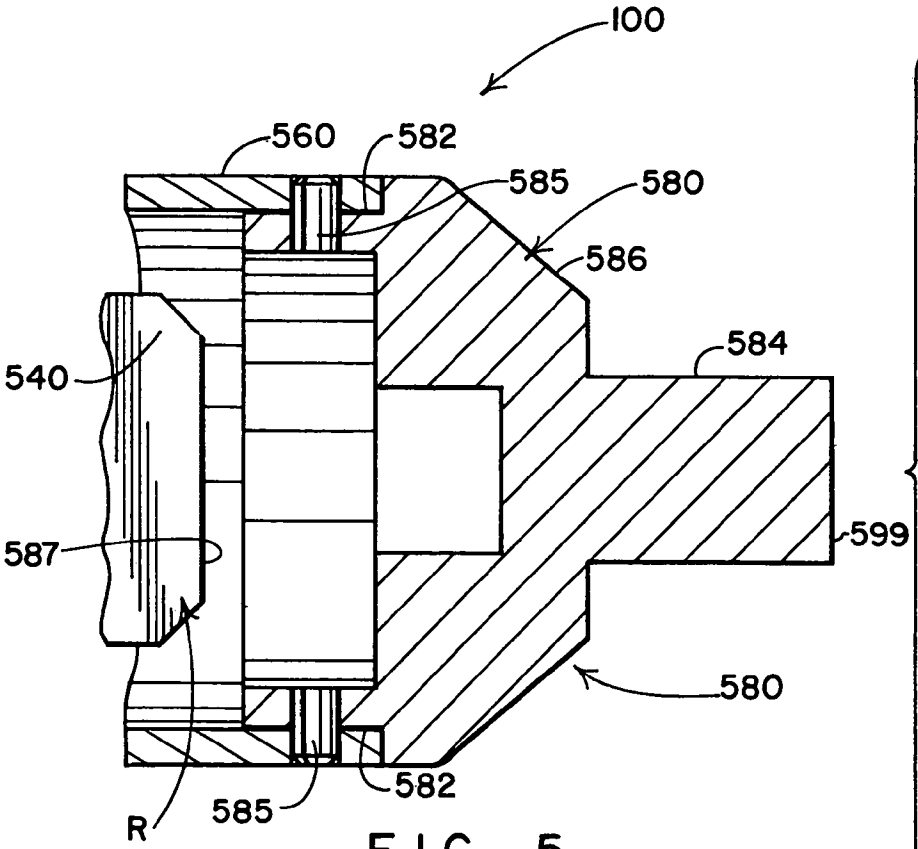
FIG. 5 is an enlarged scale sectional view of a rear portion of the push button actuator mechanism shown in FIGS. 1-4, with the view showing the tubular rear component with a nosecone shaped member connected thereto by a pair of pressed-in-place friction-fit pins, and with the view also showing a rear end region of a plunger that is situated inside the tubular rear component.

A portion of the push button subassembly 500 that extends rearwardly from the housing 200 includes a tubular rear component 560 which is visible in each of FIGS. 1-4, and also is shown in FIG. 5. As can best be seen in FIG. 5, a nosecone shaped member 580 is connected to and extends rearwardly from the rear end region of the tubular rear component 560. The tubular rear component 560 is movable between a forwardmost position shown in FIGS. 1, 2 and 4 (which does not cause the nosecone shaped member 580 and its rearmost engagement surface 599 to project very far rearwardly from the housing 200), and a rearmost position shown in FIG. 3 (which does cause the nosecone shaped member 580 and its engagement surface 599 to extend a substantial distance rearwardly from the housing 200).

Referring to FIG. 5, the nosecone shaped rear plunger element 580 has a reduced diameter front portion 582 that is sized to extend snugly forwardly into the rear end region of the tubular rear component 560. Two friction-fit pins 585 are pressed into aligned holes formed through the rear end region of the tubular rear component 560 and through the forwardly extending portion 582 of the the plunger element 580. The friction-fit pins 585 serve to rigidly connect the nosecone shaped member 580 to the rear end region of the tubular rear component 560.

Referring to FIGS. 5 and 6, the engagement surface 599 at the rear end of the nosecone shaped member 580 is defined by a relatively small diameter rearwardly extending portion 584 of the nosecone shaped member 580. A central part 586 of the nosecone shaped member 580 has a truncated conical exterior that joins smoothly with the small diameter portion 584 and extends forwardly therefrom. In normal use (i.e., when the lockable push button assembly or mechanism 100 is engaged by the engagement surface 599 to operate a mechanical locking system as is described in the Lockable Push Button Actuator Patents), the rearmost engagement surface 599 engages and causes movement of one or more components of a mechanical locking system (not shown).

Behavior of Front Components of the Actuator Assembly

The behavior described here of components of the actuator assembly or mechanism 100 is explained in greater detail in the Lockable Push Button Actuator Patents. What follows is a quick summary of behavioral aspects that are pertinent to the present invention.

When the keyway 542 is turned to the horizontal unlocked orientation, the push button P (which is biased forwardly by housing-enclosed components, not shown, of the actuator assembly 100) extends forwardly from the front face 210 of the tubular housing 200 to the fully extended position shown in FIGS. 1 and 2.

If the forwardly extending push button P is depressed from the fully extended position at a time when the keyway 542 is turned to the horizontal unlocked orientation as shown in FIG. 1, the forward biasing of the push button P will cause the push button P to return to its fully extended position just as soon as the force that caused the push button P to be depressed is released.

If the forwardly extending push button P is depressed to a position flush with the front face 210 of the housing 200 at a time when the keyway 542 is turned to the vertical locked orientation shown in FIG. 4, the push button P will be latchingly retained in the depressed protected position of FIG. 4 until the keyway 542 is turned to the horizontal unlocked orientation shown in FIG. 3, whereupon the push button P will pop back out to the fully extended position shown in FIG. 1.

Behavior of Rear Components of the Actuator Assembly

As is explained in the referenced Lockable Push Button Actuator Patents, the tubular component 560 and the plug or plunger 540 (rear portions of each of which can be seen in FIGS. 5 and 8) are able to move forwardly and rearwardly in different ways in response to movement of the push button P to and from the extended and depressed positions shown in FIGS. 1-2 and 3-4, respectively. What controls how the tubular component 560 and the plug or plunger 540 move in response to movement of the push button P is determined by how the keyway 542 is oriented when the push button P is depressed (i.e., by whether the keyway 542 is turned to the horizontal unlocked orientation of FIGS. 1 and 3, or to the vertical locked orientation of FIGS. 2 and 4, when the push button P is depressed).

For example, when the keyway 542 is turned to the horizontal unlocked orientation, both the tubular rear component 560 and the plug or plunger 540 situated inside the tubular rear component 560 are drivingly connected to, and therefore move in unison with, the push button P—so that, when the push button P is depressed rearwardly while the keyway 542 is turned to the horizontal unlocked orientation, the tubular component 560 and the plug or plunger 540 both move rearwardly in unison with the push button P. There is no relative movement between the plug or plunger 540 and the tubular component 560 during such depression of the push button P while the keyway 542 is turned to the unlocked horizontal orientation, for the members 540, 560 move in unison with the push button P.

However, when the keyway 542 is turned to the vertical locked orientation, the tubular component 560 is disconnected from the push button P and is retained in its forwardmost position (as shown in FIGS. 2 and 4) regardless of whether the push button P is extended or depressed; but the plunger 540 inside the tubular component 560 is drivingly connected to the push button P and therefore moves forwardly and rearwardly in unison with the push button P.

Unused Features of the Push Button Actuator Assembly

As has already been explained, a feature of the lockable push button actuator assembly or mechanism 100 that has not previously been put to use to operate anything is such relative movement as takes place under certain conditions between the tubular rear component 560 and the plunger 540 (which is contained within the tubular rear component 560 as can be seen in FIGS. 8 and 11).

The particular type of relative movement that is utilized by the present invention is such relative movement as takes place between the tubular rear component 560 and rear end region R (indicated in FIGS. 5, 8 and 11 by the numeral 587) of the plug or plunger 540 (which is situated concentrically inside the tubular rear component 560) as can be seen in FIG. 5. When the lockable push button actuator assembly or mechanism 100 is outfitted with the nosecone shaped member 580 (as shown in FIG. 5), the assembly or mechanism 100 is in its present conventional form—which makes no use of the rear engagement surface 587 of the plunger 540 to engage and operate any component whatsoever.

However, when the nosecone shaped member 580 is removed and replaced with the kit 900 of parts shown in FIG. 7 to provide the rear appearance shown in FIG. 8, the lockable push button actuator assembly or mechanism 100 is outfitted to operate the electrical switch S when the rear engagement surface 587 of the plunger 540 moves rearwardly relative to the tubular rear member 560 and engages (and depresses) a depressable member O of the electrical switch S which is carried by the adapter A connected to the tubular rear of member 560)—thereby causing the electrical switch S to be operated by this relative movement of the tubular member 560 and the plunger 540.

The use that is made by mechanical actuator mechanism 100 which has been converted (by replacing the nosecone shaped member 580 shown in FIG. 6 with the adapter A and switch S shown in FIG. 7) to a lockable actuator including the electrical switch S enables existing mechanical latching systems to be converted to electrical latching systems that utilize the switch S as a component of the electrical latching system.

When the push button P of a converted actuator assembly is depressed to (and perhaps also latchingly retained in) the depressed protected position shown in FIG. 9, the push button P can be depressed a fraction of an inch farther, as illustrated in FIG. 10. Since (as can be seen in FIG. 5) there is nothing situated behind the rear end region R of the plunger 540 that will be engaged and operated if the plunger 540 is depressed a fraction of an inch farther (i.e., when the plunger 540 is moved rearwardly (i.e., rightwardly as viewed in the drawing FIGURES) a short distance farther than is shown FIG. 5), depressing the push button P a fraction of an inch farther will (as shown in FIG. 10) not cause anything to be engaged and operated by the rear end region R of the plunger 540—except when the space to the right of the plunger 540 is occupied by the electrical switch S as shown in FIGS. 8 and 11.

If the push button P is manually depressed a fraction of an inch (in the manner shown in FIG. 10) at a time after the kit 900 of replacement components shown in FIG. 7 has been installed in the manner shown in FIG. 8, the rear end region R of the plunger 540 will be moved a fraction of an inch to the right (as shown in FIG. 11), causing the operator O of the electrical switch S to be engaged and depressed by the plunger's rearmost surface 587, thereby operating the electrical switch S. When a manual force causing the push button P to be further depressed (as shown in FIG. 10) is released, the plug or plunger 540 (which is biased forwardly by components of the assembly or mechanism 100 that are not shown in the drawings hereof) will return to the position shown in FIG. 8 where the operator O of the electrical switch S is no longer engaged and depressed by the surface 587, and the switch S is no longer operated. In this manner, the electrical switch S is turned "on" and "off," respectively.

The present invention takes advantage of the "depressable an additional fraction of an inch" feature of the plunger 540 to operate the electrical switch S which enables the assembly or mechanism 100 equipped with the kit 900 of components to serve as a component of electrically operated locking systems (not shown) of a variety of types.

The Retrofit "Method" Aspect of the Present Invention

In the manner just described, the present invention provides a simple method of converting, retrofitting and upgrading the assembly or mechanism 100 from being capable of operating a mechanical locking system, to function as an operator of the electrical switch S that takes the form shown in FIGS. 8 and 11.

The conversion method calls for use of a pin punch (not shown) to drive the friction-fit pins 585 depicted in FIG. 5 radially inwardly so the pins 585 no longer connect the nosecone shaped member 580 to the assembly or mechanism 100, whereupon the nosecone shaped member 580 is pulled out of and removed from the rear end region of the tubular rear member 560. The adapter A shown in FIG. 7 is then pushed into the rear end region of the tubular rear member 560, and two replacement friction-fit pins 585 shown in FIG. 7 are pressed into the aligned holes of the tubular rear member 560, which causes the adapter A to be securely attached to the tubular rear member 560.

The electrical switch S is threaded into a threaded passageway 920 of the adapter A to position the electrical switch S as shown in FIG. 8, and the two set screws 925 are threaded into aligned transversely extending threaded passageways of the adapter A to lock the switch S in position. Actually, in preferred practice, the electrical switch S is installed in the adapter A at the factory so the operator O of the switch S will be properly positioned and secured by the set screws 925 to eliminate the need to position the switch S properly when the adapter A is being installed at the rear of the tubular member 560.

Figure 12:
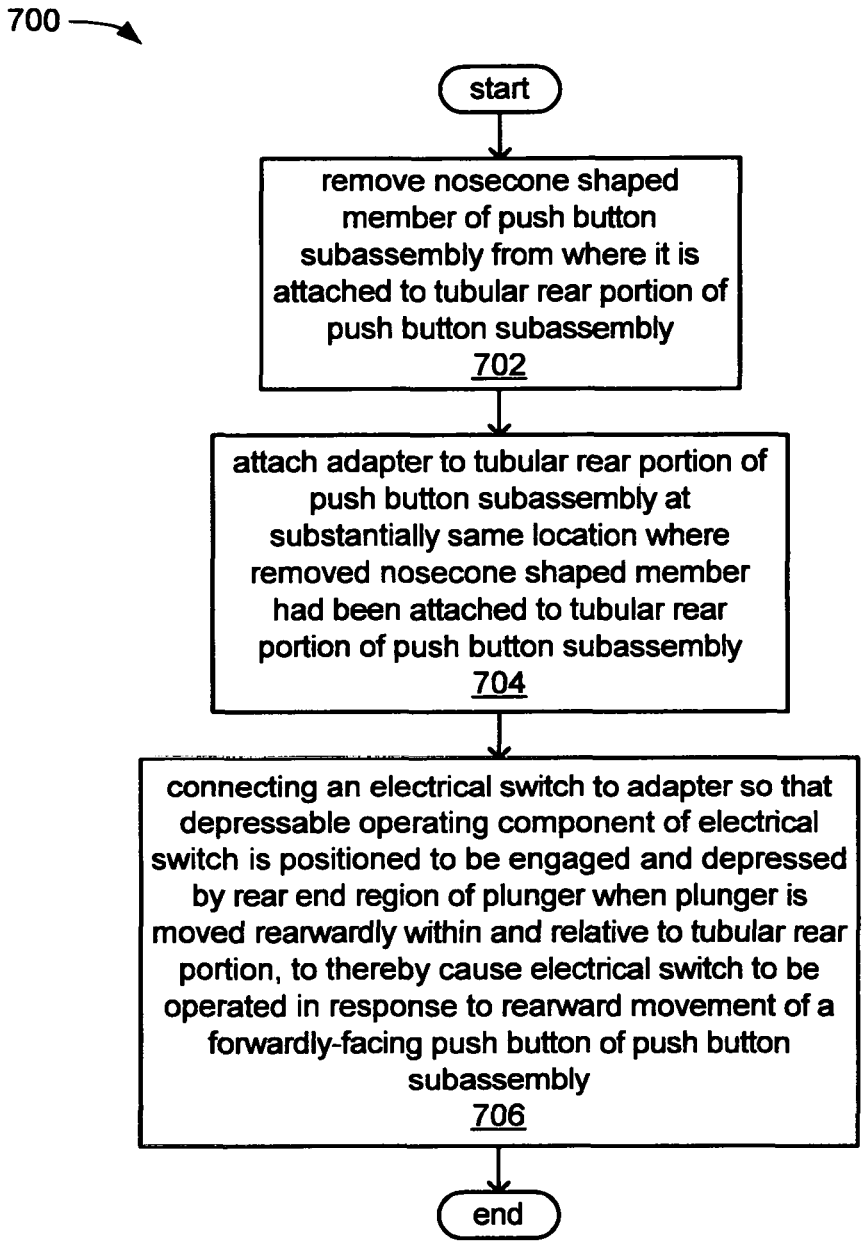
FIG. 12 is a flowchart of a method for converting a push button actuator of a mechanical locking system into a push button operated electrical switch actuator that can serve as a component of an electrical locking system.

FIG. 12 provides a flowchart 700 showing an embodiment of a method for converting a push button actuator of a mechanical locking system into a push button operated electrical switch actuator that can serve as a component of an electrical locking system, wherein: the push button actuator is of the type having a tubular housing that concentrically surrounds a push button subassembly that can be moved forwardly and rearwardly within and relative to the housing, wherein the push button subassembly has a tubular rear portion that concentrically surrounds a plunger of the push button subassembly that can be moved forwardly and rearwardly within and relative to the tubular rear portion of the push button subassembly, and wherein the plunger has a rear end region that is not utilized by the push button actuator of the mechanical locking system. At 702, a nosecone shaped member of the push button subassembly is removed from where it is attached to the tubular rear portion of the push button subassembly. At 704, an adapter is attached to the tubular rear portion of the push button subassembly at substantially the same location where the removed nosecone shaped member had been attached to the tubular rear portion of the push button subassembly. At 706, an electrical switch is connected to the adapter so that a depressable operating component of the electrical switch is positioned to be engaged and depressed by the rear end region of the plunger when the plunger is moved rearwardly within and relative to the tubular rear portion, to thereby cause the electrical switch to be operated in response to rearward movement of a forwardly-facing push button of the push button subassembly.

Operation of the Retrofitted Push Button Actuator Assembly

How a push button actuator mechanism operates once it has been retasked or retrofitted is as follows:

1) If the fully extended push button P having the keyway 542 turned to the horizontal unlocked orientation as depicted in FIG. 1 is depressed, the tubular rear component 560 will move rearwardly in the manner depicted in FIG. 3 because the tubular rear component 560 is drivingly connected to the push button P when the keyway 542 is turned to the horizontal orientation (as has been explained above), which causes the tubular rear component 560 to move in unison with the push button P.

And, as has been explained above, when the keyway 542 is turned to the horizontal unlocked orientation, the plunger 540 is also (i.e., in addition to the tubular member 560) drivingly connected to the push button P and therefore also moves in unison with the push button P—which means that the rear end region R of the plunger 540 moves rearwardly with the tubular rear component 560 which also moves rearwardly when the push button P is depressed while the keyway 542 is turned to the horizontal unlocked orientation. Accordingly, although depression of the unlocked push button P will cause the switch S to be physically moved rearwardly, the operator O of the switch S will not be depressed, hence the switch S will not be operated. ((Physical movement of the electrical switch S can, of course, be accommodated by using flexible wires (not shown) to connect to external contacts of the electrical switch S, as may be appropriate.))

What the absence of relative movement just described provides is this: when the push button P is depressed while the keyway 542 is turned to the horizontal unlocked orientation, the electrical switch S and its operator O are held in spaced relationship to (i.e., are kept away from) the rear end region R of the plunger 540, so the operator O of the electrical switch S is not engaged by, nor moved by, the plunger 540, hence the switch S cannot possibly be engaged and cannot be operated by the plunger 540.

Stated more simply, depression of the unlocked push button P does nothing to operate the electrical switch S. The non-operation of the electrical switch S when the unlocked push button P is depressed also is true if the unlocked push button P is depressed while the push button P is in the depressed protected position when the push button is in the depressed. Depression of the unlocked push button P at any time causes no operation of the electrical switch S.

2) However, if the fully extended push button P having the keyway 542 turned to the vertical locked orientation as depicted in FIG. 2 is depressed, the tubular rear component 560 is not drivingly connected to the push button P (as has been explained above)—hence, the tubular rear component 560 does not move from the forwardmost position shown in FIGS. 2 and 4. However, the plug or plunger 540 which is drivingly connected to the push button P when the keyway 542 is turned to the vertical locked orientation causes the rear end region R of the plunger 540 to move rearwardly as is shown in FIG. 11 to engage and depress the operator O of the electrical switch S—and the switch S is operated.

Stated more simply, depression of the locked push button P causes the electrical switch S to be operated. The operation of the electrical switch S when the locked push button P is depressed also is true if the locked push button P is depressed while the push button P is in the depressed beginning with the push button in the depressed position shown in FIG. 4. Depression of the locked push button P causes operation of the electrical switch S any time that the rear end region R of the plunger 540 moves rearwardly so as to cause depression of the operator O of the electrical switch S.

The Use to which the "New Product" is Put

As will readily be apparent to those who are skilled in the art, how the retrofitted assembly or mechanism 100 (i.e., the "new product" which has rear components arranged in the manner shown in FIGS. 8 and 11) is put to use as a component of an electrically operated locking system can vary greatly, and is essentially up to the designer of the electrically operated locking system.

One suggested use of the retrofitted assembly or mechanism 100 calls for the "new product" to be used as a component of a keyless remote control locking system that is electrically operated—namely a system that is readied to receive an operational signal from the electrical switch S any time that a authorized person carrying a remote control fob in his pocket or on his person is sensed by the electrically controlled locking system to be in close proximity to the electrically operated locking system. Such a system would only need an authorized person carrying a proper remote control fob to depress the push button P at a time when the keyway 542 is turned to the vertical locked orientation to cause the rear end region R of the plunger 540 to move rearwardly to bring the surface 587 into engagement with, and to depress the operator O of the electrical switch S thereby causing operation of the electrical switch S—which would cause the keyless remote electrically operated locking system to unlock.

Other kinds of electrically operated and controlled locking systems that will be well served by the retrofitted lockable push button actuator assembly or mechanism 100 will, of course, occur to those who are skilled in the art.

In Conclusion

What is explained in this section of the application will assist the reader in understanding the language of the claims, as it applies to the above-described features of the invention.

As will be apparent from the foregoing description, major components of an electrical switch actuator assembly that embodies a preferred practice of the invention includes a concentric arrangement of such elements as:

a) the tubular housing 200 which can be mounted in an opening of a panel (not shown), with the housing 200 defining a centrally located passage 205 that extends forwardly and rearwardly through the housing 200;

b) the push button P (which is a component of the push button sub-assembly 500) is slidably carried within the centrally located passage 205 of the tubular housing 200, and can be moved forwardly and rearwardly within the passage 205, with the push button P having a tubular rear region (labeled 560 in FIG. 3) that extends beyond a rear end region of the housing 200 (and, hence beyond the rear end region of the passage 205 that extends centrally through the housing 200);

c) the generally cylindrical plunger 540 (which also is indicated by the letter R in FIG. 8) that is slidably carried within the tubular rear portion of the push button P, with the plunger 540 or R having a rear end surface 587.

The electrical switch actuator also includes an adapter A that is connected to the tubular rear region 560 of the push button P and that moves forwardly and rearwardly in unison with the push button P, with the adapter defining a threaded passage 920 extending centrally therethrough and opening at its front end toward the rear end surface 587 of the plunger 540 (also labeled R).

The electrical switch actuator also includes the electrical switch S that has a housing with a threaded region 910 that extends into the threaded passage 920 of the adapter A, with the adapter A also serving to connect the electrical switch S to the push button P for forward and rearward movement therewith. Further, the electrical switch S has a forwardly extending depressable operating component O that can be engaged by the rear end surface 587 of the rear end region R of the plunger when the plunger is moved rearwardly relative to the push button P to thereby cause the electrical switch S to be operated.

As will also be apparent from the foregoing description, a kit of parts (designated by the numeral 900 in FIG. 7) for converting a push button actuator of a mechanical locking system such as is disclosed in detail in the referenced Push Button Actuator Patents, and which is indicated by the reference numeral 100 in FIGS. 1-4) into a push button operated electrical switch actuator that can serve as a component of an electrical locking system, includes:

a) an adapter A that can be connected to the tubular rear portion 560 (see FIG. 5) of the push button P at substantially the same location where a nosecone shaped member 580 (FIG. 6) has been removed from the tubular rear portion of the push button P; and, b) an electrical switch S having a housing with a portion 910 (FIGS. 7-11) that can be threaded inserted into a passage 920 (FIGS. 8 and 11) of the adapter A to position a depressable operating component O (FIGS. 7, 8 and 11) of the electrical switch S to be engaged and depressed by the rear end region 587 of the plunger 540 when the push button P is moved rearwardly, to thereby cause the electrical switch S to be operated in response to the rearward movement of the push button P.

As will also be apparent from the foregoing description, a preferred method for converting a push button actuator of a mechanical locking system (100, as disclosed in the referenced Push Button Actuator Patents) into a push button operated electrical switch actuator (as described above) that can serve as a component of an electrical locking system, includes the steps of:

a) removing a nosecone shaped member 580 (best shown in FIG. 6) from where it is attached to the tubular rear portion of the push button P of the actuator;

b) attaching an adapter A (best shown in FIG. 7) to the tubular rear portion of the push button P at substantially the same location where the removed nosecone shaped member 580 had been attached to the tubular rear portion of the push button P; and, c) connecting the electrical switch S to the adapter A so that a depressable operating component O of the electrical switch S is positioned to be engaged and depressed by the rear end region 587 of the plunger 540 when the push button P is moved rearwardly, to thereby cause the electrical switch S to be operated in response to the rearward movement of the push button P.

Although the invention has been described in its preferred form with a certain degree of particularity, it is understood that the present disclosure of the preferred form has been made only by way of example, and that numerous changes in the details of construction and the combination and arrangement of parts and the manner of operation may be resorted to without departing from the spirit and scope of the invention. It is intended that this application will protect whatever features of patentable novelty that exist in the invention disclosed herein.

What is claimed is:

1. A method of converting a push button actuator of a mechanical locking system into a push button operated electrical switch actuator serving as a component of an electrical locking system, wherein the push button actuator is of the type having a tubular housing that concentrically surrounds a push button subassembly that can be moved forwardly and rearwardly within and relative to the housing, wherein the push button subassembly has a tubular rear portion that concentrically surrounds a plunger of the push button subassembly that can be moved forwardly and rearwardly within and relative to the tubular rear portion of the push button subassembly, and wherein the plunger has a rear end region that is not utilized by the push button actuator of the mechanical locking system, the method comprising the steps of:

a) removing a nosecone shaped member of the push button subassembly from where it is attached to the tubular rear portion of the push button subassembly;

b) attaching an adapter to the tubular rear portion of the push button subassembly at substantially the same location where the removed nosecone shaped member had been attached to the tubular rear portion of the push button subassembly; and c) connecting an electrical switch to the adapter so that a depressable operating component of the electrical switch is positioned to be engaged and depressed by the rear end region of the plunger when the plunger is moved rearwardly within and relative to the tubular rear portion, to thereby cause the electrical switch to be operated in response to rearward movement of a forwardly-facing push button of the push button subassembly.

2. The method of claim 1 further comprising positioning the electrical switch relative to the adapter to cause the operating component of the electrical switch to be engaged and depressed by the rear end region of the plunger when a keyway formed in the forwardly-facing push button of the push button subassembly is rotated by operation of an inserted key from an unlocked orientation to a locked orientation and the forwardly-facing push button is moved rearwardly.

3. The method of claim 1 wherein the step of connecting an electrical switch to the adapter includes threading a housing of the electrical switch into a threaded passage of the adapter.

4. The method of claim 3 wherein the step of connecting an electrical switch to the adapter additionally includes the step of securing the housing of the electrical switch to the adapter by tightening at least one set screw carried by the adapter into engagement with the housing of the electrical switch.

5. The method of claim 1 wherein the step of removing a nosecone shaped member of the push button subassembly from where it is attached to the tubular rear portion of the push button subassembly includes the step of removing one or more press-fit pins that extend through aligned holes of the nosecone shaped member and the tubular rear portion of the push button subassembly.

6. The method of claim 5 wherein the step of attaching an adapter to the tubular rear portion of the push button subassembly includes the step of inserting one or more replacement press-fit pins into holes of the adapter that are aligned with holes of the tubular rear portion of the push button subassembly from which press-fit pins have been removed during removal of the nosecone shaped member from the tubular rear portion of the push button subassembly.

7. The method of claim 1 further comprising positioning the electrical switch relative to the adapter to prevent the operating component of the electrical switch from being engaged and depressed by the rear end region of the plunger when the forwardly-facing push button of the push button subassembly is moved rearwardly from a first position extending farther forward than a forwardly-facing portion of the housing, and to a second position that is flush with the forwardly-facing portion of the housing.

8. The method of claim 7 further comprising positioning the electrical switch relative to the adapter to cause the operating component of the electrical switch to be engaged and depressed by the rear end region of the plunger when the forwardly-facing push button of the push button subassembly is moved rearwardly from the second position, and to a third position that is recessed rearwardly into the housing to an extent that is farther rearward than the forwardly-facing portion of the housing.

9. A kit of parts for converting a push button actuator of a mechanical locking system into a push button operated electrical switch actuator serving as a component of an electrical locking system, wherein the push button actuator is of the type having a tubular housing that concentrically surrounds a push button subassembly that can be moved forwardly and rearwardly within and relative to the housing, wherein the push button subassembly has a tubular rear portion that concentrically surrounds a plunger of the push button subassembly that can be moved forwardly and rearwardly within and relative to the tubular rear portion of the push button subassembly, and wherein the plunger has a rear end region that is not utilized by the push button actuator of the mechanical locking system, the kit of parts comprising:

a) an adapter that can be connected to the tubular rear portion of the push button subassembly in place of and at substantially the same location where a nosecone shaped member of the push button subassembly has been removed from the tubular rear portion;

b) an electrical switch having a housing that can be inserted into a passage of the adapter to position a depressable operating component of the electrical switch to be engaged and depressed by the rear end region of the plunger when the plunger is moved rearwardly within and relative to the tubular rear portion, to thereby cause the electrical switch to be operated in response to rearward movement of a forwardly-facing push button of the push button subassembly;

c) at least one fastener configured to be mounted by the adapter and tightened into engagement with the housing of the electrical switch to secure the adapter's mounting of the electrical switch; and d) at least one friction-fit pin that can be inserted into aligned holes defined by the adapter and the tubular rear portion of the push button subassembly to securely connect the adapter to the tubular rear portion of the push button subassembly in place of the nosecone shaped member.

10. An electrical switch actuator, comprising:

a) a tubular housing that can be mounted in an opening of a panel, with the housing defining a centrally located passage extending forwardly and rearwardly through the housing;

b) a push button subassembly slidably carried within the centrally located passage for moving forwardly and rearwardly within the passage of the housing, with the push button subassembly having a tubular rear portion extending beyond a rear end region of the passage;

c) a generally cylindrical plunger slidably carried within the tubular rear portion of the push button subassembly and having a rear end surface;

d) an adapter connected to the tubular rear portion of the push button subassembly for forward and rearward movement with the tubular rear portion of the push button subassembly, with the adapter defining a through passage that opens toward the rear end surface of the plunger; and e) an electrical switch having a housing that extends into the through passage defined by the adapter to connect the electrical switch to the adapter for forward and rearward movement with the adapter and with the tubular rear portion of the push button subassembly, and with the electrical switch having a forwardly extending depressable operating component engaged by the rear end surface of the plunger when the plunger is moved rearwardly within and relative to the tubular rear portion of the push button subassembly to thereby cause operation of the electrical switch.

11. The electrical switch actuator of claim 10 additionally including at least one fastener mounted by the adapter and tightened into engagement with the housing of the electrical switch to secure the adapter's mounting of the electrical switch.

12. The electrical switch actuator of claim 10 additionally including at least one friction-fit pin inserted into aligned holes defined by the adapter and the tubular rear portion of the push button subassembly to securely connect the adapter to the tubular rear portion of the push button subassembly.

13. The electrical switch actuator of claim 10 wherein:

the push button subassembly further comprises a forwardly-facing push button drivingly connected to the plunger of the push button subassembly for forward-rearward movement with the plunger;

the forwardly-facing push button may be moved forwardly-rearward toward and away from a position in which the forwardly-facing push button is flush with a forwardly-facing portion of the housing;

a keyway is formed in the forwardly-facing push button that is rotatable by operation of an inserted key between an unlocked orientation and a locked orientation; and rotation of the keyway to one of the unlocked orientation and the locked orientation controls whether the rear end surface of the plunger engages the operating component of the electrical switch when the plunger is moved rearwardly.

14. The electrical switch actuator of claim 13 wherein rearward movement of the rear end surface of the plunger to engage the depressable operating component of the electrical switch requires rearward movement of the forwardly-facing push button to a position that is recessed rearwardly into the housing to an extent that is farther rearward than the forwardly-facing portion of the housing.

15. The electrical switch actuator of claim 13 wherein rearward movement of the rear end surface of the plunger within and relative to the tubular rear portion to engage the depressable operating component of the electrical switch requires rotation of the keyway to the locked orientation to decouple forward-rearward movement of the tubular rear portion from forward-rearward movement of the forwardly-facing push button and the plunger.

16. A kit of parts for converting a push button actuator of a mechanical locking system into a push button operated electrical switch actuator serving as a component of an electrical locking system, wherein the push button actuator is of the type having a tubular housing that concentrically surrounds a push button subassembly that is moved forwardly and rearwardly within and relative to the housing, wherein the push button subassembly has a tubular rear portion that concentrically surrounds a plunger of the push button subassembly that is moved forwardly and rearwardly within and relative to the tubular rear portion of the push button subassembly, and wherein the plunger has a rear end region that is not utilized by the push button actuator of the mechanical locking system, the kit of parts comprising:

a) an adapter connected to the tubular rear portion of the push button subassembly in place of and at substantially the same location where a nosecone shaped member of the push button subassembly has been removed from the tubular rear portion; and b) an electrical switch having a housing inserted into a passage of the adapter to position a depressable operating component of the electrical switch to be engaged and depressed by the rear end region of the plunger when the plunger is moved rearwardly within and relative to the tubular rear portion, to thereby cause the electrical switch to be operated in response to rearward movement of a forwardly-facing push button of the push button subassembly; wherein the adapter is configured to cooperate with the electrical switch to position the depressable operating component of the electrical switch to be engaged and depressed only when the forwardly-facing push button is moved rearwardly to a position that is recessed rearwardly into the housing to an extent that is farther rearward than a forwardly-facing portion of the housing.

17. A kit of parts for converting a push button actuator of a mechanical locking system into a push button operated electrical switch actuator serving as a component of an electrical locking system, wherein the push button actuator is of the type having a tubular housing that concentrically surrounds a push button subassembly that can be moved forwardly and rearwardly within and relative to the housing, wherein the push button subassembly has a tubular rear portion that concentrically surrounds a plunger of the push button subassembly that can be moved forwardly and rearwardly within and relative to the tubular rear portion of the push button subassembly, and wherein the Plunger has a rear end region that is not utilized by the push button actuator of the mechanical locking system, the kit of parts comprising:

a) an adapter connected to the tubular rear portion of the push button subassembly in place of and at substantially the same location where a nosecone shaped member of the push button subassembly has been removed from the tubular rear portion; and b) an electrical switch having a housing inserted into a passage of the adapter to position a depressable operating component of the electrical switch to be engaged and depressed by the rear end region of the plunger when the plunger is moved rearwardly within and relative to the tubular rear portion, to thereby cause the electrical switch to be operated in response to rearward movement of a forwardly-facing push button of the push button subassembly; wherein the adapter is configured to cooperate with the electrical switch to position the depressable operating component of the electrical switch to be engaged and depressed only when forward-rearward movement of the plunger is decoupled from forward-rearward movement of the tubular rear portion such that the tubular rear portion is caused to not move forwardly-rearwardly relative to the housing as the rear end region of the plunger moves rearwardly within the tubular rear portion.

18. The kit of parts of claim 17 wherein rearward movement of the rear end region of the plunger within and relative to the tubular rear portion to engage and depress the depressable operating component of the electrical switch requires rotation of a keyway formed in the forwardly-facing push button from an unlocked orientation to a locked orientation to decouple forward-rearward movement of the tubular rear portion from forward-rearward movement of the forwardly-facing push button and the plunger.

* * * * *